United States Patent [19]

Suttles

[11] 3,983,822

[45] Oct. 5, 1976

[54] SHELVING SYSTEM

[76] Inventor: James Marshall Suttles, 822 Elm St., Elberton, Ga. 30637

[22] Filed: July 30, 1975

[21] Appl. No.: 600,488

[52] U.S. Cl. ..... 108/108; 108/152; 211/193; 248/224; 248/243

[51] Int. Cl.[2] ..... A47B 96/12

[58] Field of Search ..... 108/32, 108, 111, 152, 108/1, 6, 10, 96, 106, 107; 248/224, 242, 243; 211/49 R, 49 S, 148, 176, 177, 193

[56] References Cited

UNITED STATES PATENTS

| | | | |
|---|---|---|---|
| 2,788,949 | 4/1957 | Gurries | 248/242 |
| 2,936,147 | 5/1960 | Stewart | 248/243 |
| 3,080,980 | 3/1963 | Gibbons | 211/176 X |
| 3,101,923 | 8/1963 | Streater | 248/242 |
| 3,212,648 | 10/1965 | Baker, Jr. et al. | 108/108 X |
| 3,503,524 | 3/1970 | Krummell et al. | 211/177 X |
| 3,556,023 | 1/1971 | Marschak | 108/1 |
| 3,729,161 | 4/1973 | Christensen | 248/242 |

FOREIGN PATENTS OR APPLICATIONS

| | | | |
|---|---|---|---|
| 411,278 | 4/1966 | Switzerland | 211/148 |
| 968,263 | 9/1964 | United Kingdom | 248/242 |

*Primary Examiner*—Roy D. Frazier
*Assistant Examiner*—William E. Lyddane

[57] ABSTRACT

In a shelving system having both vertical and oblique supports for removable shelves, identical shelves are interchangeably usable on either support by reason of the fact that mounting slots on the oblique support are farther apart than the mounting slots on the vertical support. The tabs on the shelves cooperate with these slots in two different ways, depending on the slot spacing, thereby automatically insuring the proper shelf orientation, irrespective of the support.

9 Claims, 4 Drawing Figures

SHELVING SYSTEM

CROSS REFERENCE TO RELATED APPLICATIONS

This application disclosed subject matter claimed in the application of James L. Hanna, Ser. No. 600,412, field July 30, 1975, and in the application of John E. Breeden and Joseph J. Clement, Ser. No. 600,489, filed July 30, 1975, now abandoned.

BRIEF SUMMARY OF THE INVENTION

This invention relates to shelving systems, and particularly to a system of shelving wherein removable shelves are arranged on vertical and oblique slotted shelf support members.

The invention is particularly adapted, but not necessarily limited to use in the construction of soft drink display racks. Display racks, constructed of sheet metal are commonly used in grocery stores, supermarkets and the like for the display of soft drinks. Soft drinks are sold in bottles of various sizes, the smaller bottles are commonly packaged in cartons, and the larger quart sizes being in the form of individual bottles. The sizes of the small bottles may vary, and the relative proportion of cartons to large bottles in a particular display also varies, depending on the demand experienced by the particular vendor. For these reasons, soft drink display racks are normally supplied with removable shelves, adapted to be positioned for the optimum usage of available space.

A typical beverage rack comprises a sheet metal base, and a vertical shelf support extending upwardly from the rear of the base. Soft drink cartons are normally stacked on the base, and larger bottles are normally arranged on the shelves. In order to stabilize the stack of cartons, the upper surface of the base is tilted backwardly by a few degrees, and the backing, or shelf support is correspondingly tilted backwardly. This backward tilting provides a stable support for a stack of cartons, which can be four or five cartons high at times. The backward tilting also results in a shelf support which is wider at the bottom than at the top. Therefore it provides a stronger support for the shelves. In order to achieve a more efficient use of the available space, the shelf support consists of two parts, namely the lower part, having an oblique front, and a substantially vertical upper part.

Desirably, shelves can be mounted on either the vertical or the oblique shelf support. However, the shelves, being provided for the purpose of holding individual bottles, should be essentially horizontal (perhaps with a slight backward tilt). Normally, this would necessitate the use of two different kinds of shelf, depending upon whether the shelf is to be mounted on the vertical support or on the oblique support.

In accordance with this invention, the vertical support has a planar front surface disposed vertically, and has a series of uniformly spaced slots extending in the vertical direction on its front surface. The oblique support also has a planar front surface, disposed at an oblique angle with respect to the horizontal, and has a second series of uniformly spaced slots extending in the vertical direction on its front surface. The spacing of the slots in the second series is different from the spacing of the slots in the first series.

The interchangeable shelf has, at its rear, a first tab provided with an upwardly extending projection extendable through one of the slots and engageable with the rear wall of the support in which said slot is located. The shelf also has first means adapted to abut the front surface of a support, and a second tab located below the first tab and having a surface spaced horizontal away from said first means and also adapted to abut the front surface of a support. These tabs are spaced from each other by a distance equal to an integral multiple of the slot spacing on the upper support.

Thus, when the shelf is mounted on the lower support, it is positioned with the first means abutting the front surface of the lower support, and when the shelf is mounted on the upper support, it is necessarily positioned with the surface of the second tab abutting the front surface of the upper support. In this way, the shelf is automatically positioned horizontally, irrespective of which support it is mounted on.

Preferably, for full support, the shelf has at its rear a first tab provided with an upwardly extending projection extendable through one of the slots, and engageable with the rear wall of the support in which said one of said slots is located, and also has first means adapted to abut the front surface of a support, and second and third tabs, below the first tab and spaced from each other and from the first tab by distances such that when the shelf is mounted on the lower support, all three tabs extend fully through the slots and the first means abuts the front surface of the lower support, and each of the second and third tabs, comprises a projection extending rearwardly from the first means, and a heel extending downwardly from the projection and outwardly from the first means, the bottoms of said projections being spaced from the bottom of said first tab by integral multiples of distance between the bottoms of adjacent slots in the upper support and the heels of the second and third tabs being aligned with the intersection of the first tab and said first means so that when the shelf is mounted on the upper support, the heels of the second and third tabs abut the front surface thereof, and the projections extend into and rest on the bottoms of their respective slots.

DETAILED DESCRIPTION

Figure 1:
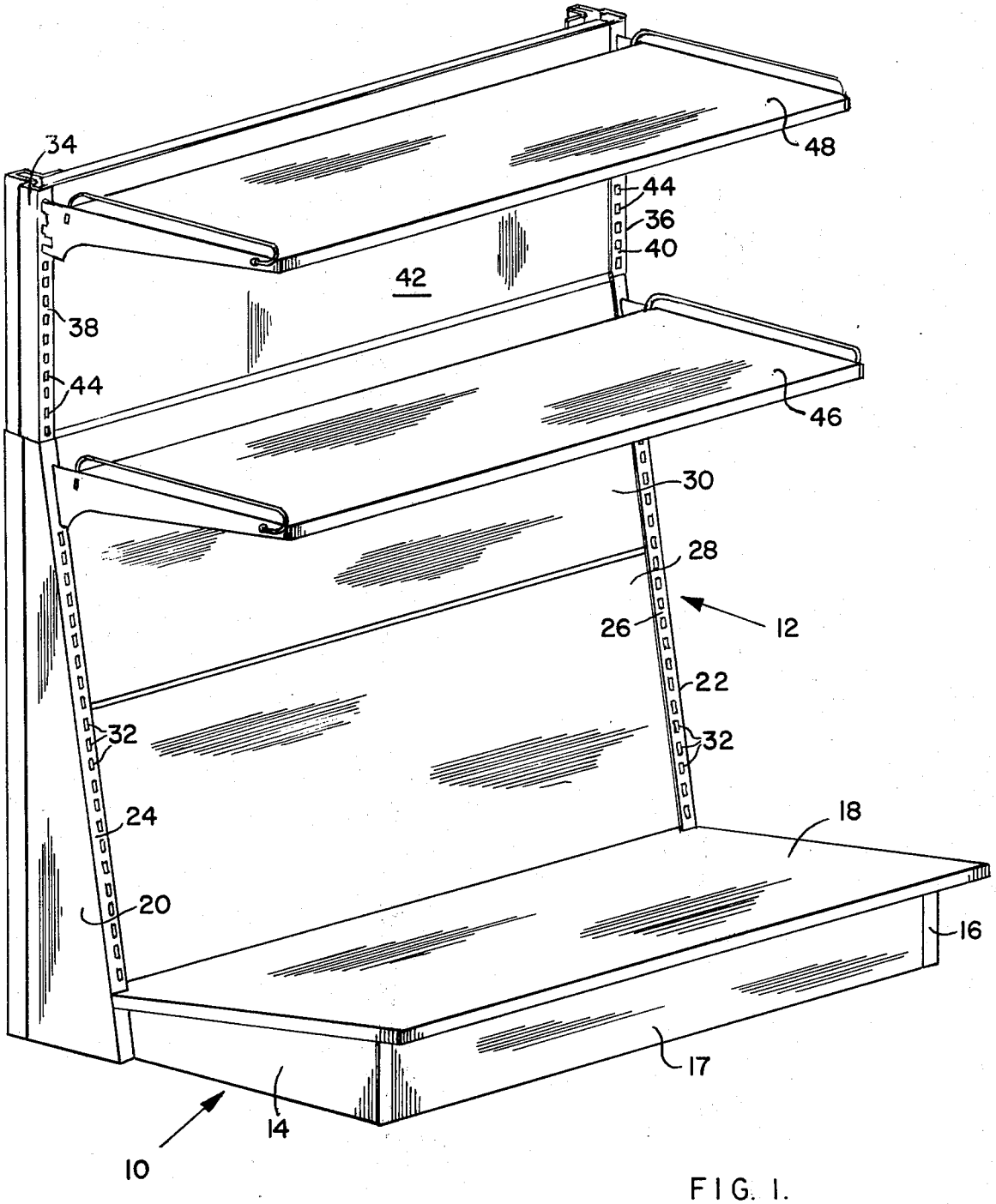
FIG. 1 is a perspective view of a shelving system in accordance with the invention.

FIG. 1 shows a soft drink display rack comprising a base 10 and an upright back 12. Base 10 comprises a pair of opposed side members 14 and 16, a front kick plate 17, and a top surface 18. Top surface 18 is sloped backward slightly, preferably from about 3 degrees to about 7 degrees from horizontal. Side members 14 and 16 of the base are formed of sheet metal, and are integral with side members 20 and 22 respectively of the back.

These side members are wider at the bottom than at the top, and have front surfaces 24 and 26 which are preferably perpendicular to top surface 18 of the base, and therefore oblique with respect to the horizontal.

Panels 28 and 30 are mounted on side members 20 and 22, and are likewise oblique and form a backing, allowing a stack of soft drink cartons to be supported at the bottom by surface 18, and at the rear by sloping panels 28 and 30.

Surfaces 24 and 26 have slots 32, which are uniformly spaced, and arranged in vertical lines. Surfaces 24 and 26 are integral with side members 20 and 22, and are of heavy-gauge sheet metal. The space immediately behind these slots is clear.

The upper part of back member 12 comprises vertically extending members 34 and 36. These members preferably have uniform cross-section, and their front surfaces 38 and 40 are preferably vertical, although they may be sloped at some other desired angle relative to the horizontal. Members 34 and 36 fit into the tops of members 20 and 22 respectively in telescoping relationship. The manner in which they are secured therein will be discussed with reference to FIGS. 5, 7, 8, 9 and 10.

A third panel 42 is secured between members 34 and 36. Panel 42 is vertical.

Elements 34 and 36 are provided with rows of uniformly spaced slots 44, arranged in vertical lines.

Figure 3:
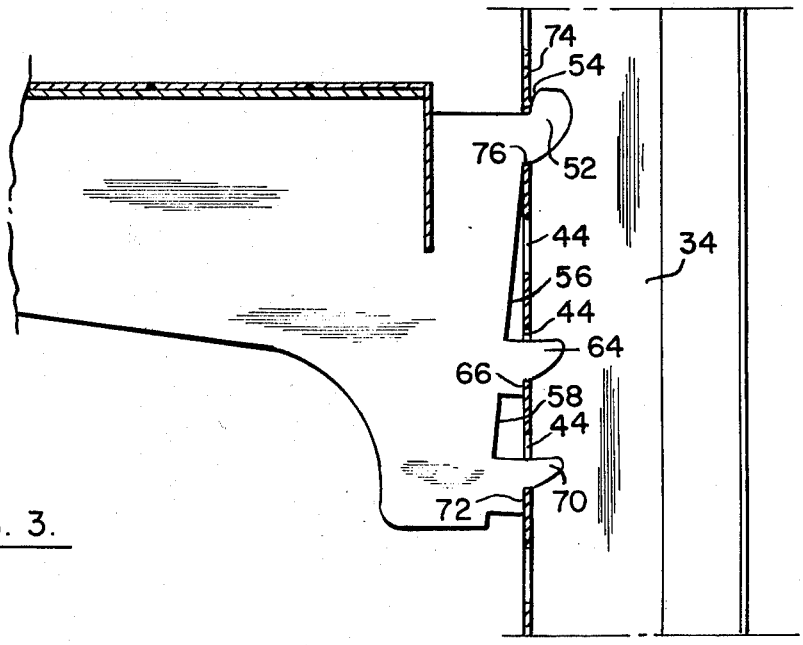
FIG. 3 is a vertical section showing how the tabs on the rear portion of a shelf cooperate with the slots in a vertical support member.
Figure 4:
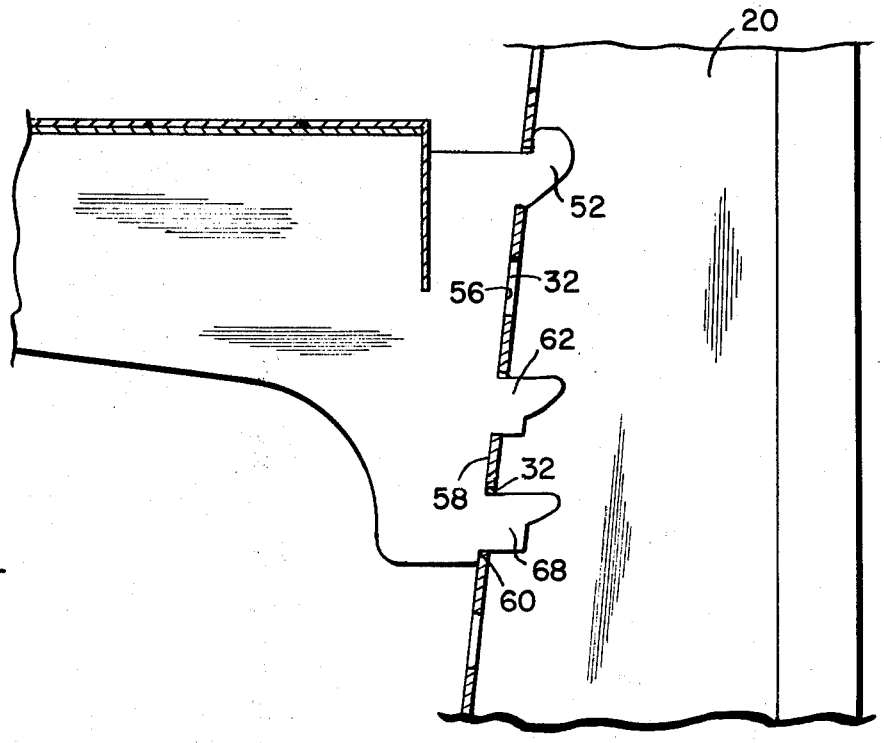
FIG. 4 is a vertical section showing how the tabs at the rear of the shelf cooperate with the slots on an oblique support member.

A first shelf 46, the upper surface of which is substantially horizontal, is shown supported on members 20 and 22. A second shelf 48, which is also horizontal, is shown mounted on members 34 and 36. Both these shelves are identical. The manner in which they cooperate with the slots in the supporting members is illustrated in FIGS. 2, 3 and 4.

Figure 2:
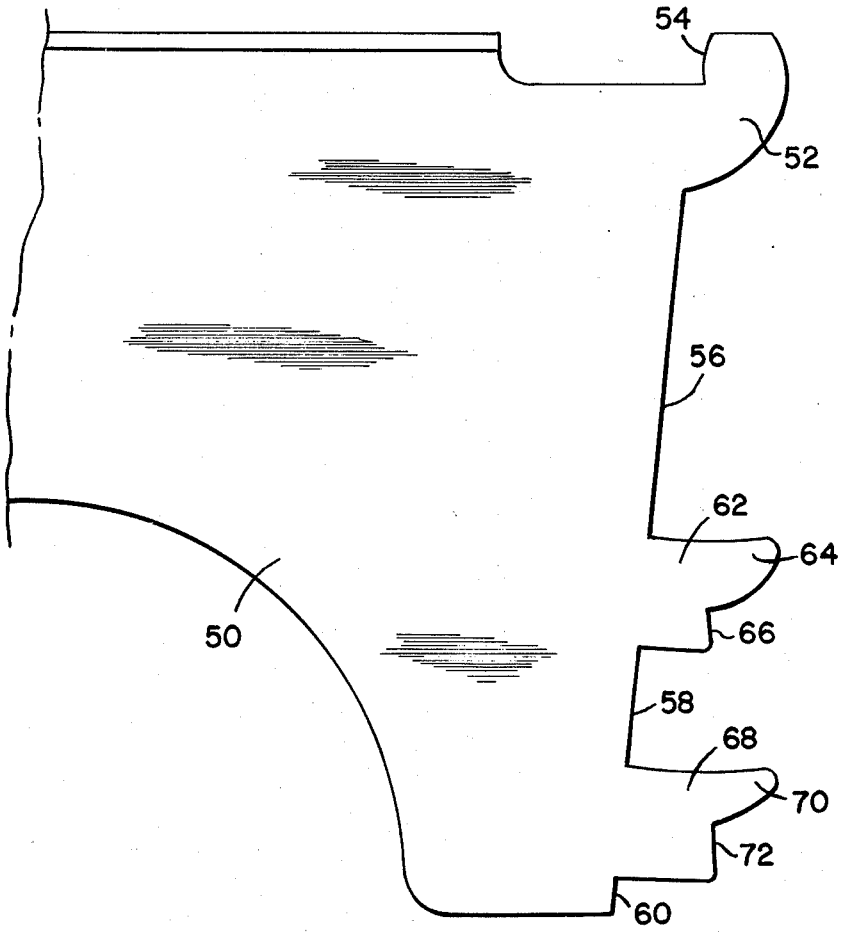
FIG. 2 is a side elevation of the rear portion of a shelf in accordance with the invention, showing the tabs.

Referring to FIG. 2, the shelf, has at either side a vertical, flat, heavy gauge, sheet metal support 50, having near its upper edge a first tab 52 which extends rearwardly, and then upwardly so that it is adapted to extend through a slot and engage with the rear wall of the support in which the slot is located. The surface 54 which engages the rear wall of the slot is preferably rounded because, as will be seen, this surface engages the rear wall of the support in two different ways, depending on whether the support is vertical or oblique. The rounded configuration at 54 insures minimum stress in both orientations.

Below tab 52 is an edge 56, which is continued in a straight line at 58 and 60. This edge is adapted to abut the front surface of a support.

A second tab 62 comprises a rearwardly extending projection 64 and a heel 66 extending downwardly from projection 64 and rearwardly from edge 58. A third tab 68 also comprises a rearwardly extending projection 70 and a heel 72, which extends downwardly from projection 70 and rearwardly from edge 60.

The manner in which the shelf is secured to vertical support member 34 is illustrated in FIG. 3. Tab 52 extends through one of slots 44, with surface 54 of tab 52 engaging the rear wall 74 of the support. Edge 56 intersects the bottom of tab 52 at 76, and this intersection rests on the bottom of the slot through which tab 52 extends. Projection 64 extends through a lower one of slots 44 with the bottom of the projection resting on the lower edge of the slot. Heel 66 abuts the front surface of the support. Similarly, projection 70 extends through the next lower one of slots 44, and the bottom of projection 70 rests on the lower edge of this slot, with heel 72 abutting the front surface of support 34.

Heels 66 and 72 are aligned with each other and with intersection 76 so that both heels abut the front surface of support 34. The spacing between the bottom of projection 64 and intersection 76 is equal to twice the spacing between the bottoms of adjacent slots. The spacing between the bottom of projection 70 and intersection 76 is equal to three times the spacing between the bottoms of adjacent slots. In this way, vertical support for the shelf is provided at three points. The spacing between intersection 76 and the bottom of a tab could be, of course, any integral multiple of the distance between the bottoms of adjacent slots in support member 34.

Now referring to FIG. 4, which shows the same shelf secured to oblique support 20, it will be seen that slots 32 are spaced further apart from each other than slots 44. Tabs 62 and 68 extend fully through slots 32 so that aligned edges 56, 58 and 60 abut the front surface of support 20. Again, vertical support is provided at three points, where the tabs rest on the lower edges of the respective slots through which they extend. Because all of the slots in both the vertical and oblique support members must be substantially the same size in order to accommodate tab 52 effectively, tabs 62 and 68 have to be shaped differently from each other in order that both tabs may be vertically supported by the bottoms of their respective slots regardless of which support is being used. This accounts for the fact that, as shown in FIG. 2, projection 64 has a greater vertical dimension than projection 70 and the fact that heel 72 has a greater vertical dimension than heel 66.

A shelf is installed on either support by first tilting it so that tab 52 can enter a slot, then lowering the shelf to the horizontal position so that tabs 62 and 68 can enter their respective slots. Because of the special spacing and configuration of the tabs, the shelf will automatically assume the horizontal position regardless of which support it is mounted on. While an upper tab corresponding to tab 52 and two lower tabs corresponding to tabs 62 and 68 are preferred because of the support which they provide for the shelf, it will be apparent that a greater or lesser number of tabs may be used if desired.

What has been described thus far applies to the supports on the left-hand side of FIG. 1. The interconnections between the supports and the shelf on the right-hand side of FIG. 1 are similar, and need not be described. Obviously, any number of supports may be used with suitable modifications.

I claim:

1. A system of shelving wherein identical shelves may be mounted interchangeably on supporting members having surfaces disposed at different angles relative to the horizontal, said system comprising:

a first support having a planar front surface disposed at a first angle with respect to the horizontal and having a first series of uniformly spaced slots extending in the vertical direction on said surface;

a second support having a planar front surface disposed at a second angle with respect to the horizontal, said second angle being different from said first angle, and having a second series of uniformly spaced slots extending in the vertical direction on said surface, the spacing of the slots in said second series being different from the spacing of the slots in said first series; and a shelf having at its rear a first tab provided with a projection extendible through one of said slots on either support and engageable with the rear wall of the support in which said one of said slots is located, said shelf also including first means adapted to abut the front surface of said first support, and a second tab located below said first tab, said second tab having a surface spaced horizontally away from said first means and adapted to abut the front surface of said second support, said tabs being spaced from each other in relation to the spacing of the slots on said supports, and said first means and said surface of said second tab being configured so that, when on the first support, said shelf is necessarily positioned with the first means abutting the front surface of said first support, and when on said second support, said shelf is necessarily positioned with said surface of said second tab abutting the front surface of said second support.

2. A system of shelving according to claim 1 wherein the planar front surface of said second support is substantially vertical, and wherein the planar front surface of said first support is oblique and upwardly facing.

3. A system of shelving according to claim 1 wherein the slots in said first series are farther apart from each other than the slots in said second series.

4. A system of shelving according to claim 1 in which the second tab comprises a projection and in which said surface spaced horizontally away from said first means is a heel extending downwardly from said projection at a point spaced horizontally away from the end of said projection.

5. A system of shelving wherein identical shelves may be mounted interchangeably on supporting members having surfaces disposed at different angles relative to the horizontal, said system comprising:

a first support having a planar front surface disposed at a first angle with respect to the horizontal and having a first series of uniformly spaced slots extending in the vertical direction on said surface;

a second support having a planar front surface disposed at a second angle with respect to the horizontal, said second angle being different from said first angle, and having a second series of uniformly spaced slots extending in the vertical direction on said surface, the spacing of the slots in said second series being different from the spacing of the slots in said first series, and a shelf having at its rear a first tab provided with an upwardly extending projection extendible through one of said slots on either support, and engageable with the rear wall of the support in which said one of said slots is located, said shelf also having first means adapted to abut the front surface of said first support, and second and third tabs, below said first tab and spaced from each other and from said first tab in relation to the spacings of the slots on said supports to that, when said shelf is mounted on said first support, all three tabs extend fully through the slots on said first support and said first means abuts the front surface of said first support, and, when said shelf is mounted on said second support, said second and third tabs cannot extend fully through the slots on said second support, each of said second and third tabs comprising a projection extending rearwardly from said first means, and a heel extending downwardly from said projection and outwardly from said first means, the bottoms of said projections being spaced from the bottom of said first tab by integral multiples of the distance between the bottoms of adjacent slots in the second support and the heels of the second and third tabs being aligned with the intersection of the first tab and said first means, so that, when said shelf is mounted on said second support, the heels of the second and third tabs abut the front surface thereof, and said projections extend into and rest on the bottoms of their respective slots.

6. A system of shelving according to claim 1 in which said surface of said second tab is positioned with respect to said first means so that said shelf is disposed at substantially the same angle with respect to the horizontal whether said shelf is on said first support or on said second support.

7. A system of shelving according to claim 1 in which said surface of said second tab is positioned with respect to said first means so that said shelf is disposed substantially horizontally whether said shelf is on said first support or on said second support.

8. A system of shelving according to claim 1 wherein said first support constitutes a part of a base for the system of shelving, and wherein said second support is secured to the upper end of said first support and extends upwardly therefrom.

9. A system of shelving according to claim 5 wherein said first support constitutes part of a base for the system of shelving, and wherein said second support is secured to the upper end of said first support and extends upwardly therefrom.

* * * * *